US009902553B2

(12) United States Patent
Polloni et al.

(10) Patent No.: US 9,902,553 B2
(45) Date of Patent: Feb. 27, 2018

(54) PACKET OF SMOKING ARTICLES PROVIDED WITH AN INNER PACKAGE HAVING A RECLOSABLE EXTRACTION OPENING

(71) Applicant: G.D SOCIETA' PER AZIONI, Bologna (IT)

(72) Inventors: Roberto Polloni, Modigliana (IT); Manuela Mardare, Bologna (IT); Stefano Negrini, Calderara di Reno (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 0 days.

(21) Appl. No.: 15/322,462

(22) PCT Filed: Jun. 29, 2015

(86) PCT No.: PCT/IB2015/054873
§ 371 (c)(1),
(2) Date: Dec. 28, 2016

(87) PCT Pub. No.: WO2016/001826
PCT Pub. Date: Jan. 7, 2016

(65) Prior Publication Data

US 2017/0152100 A1 Jun. 1, 2017

(30) Foreign Application Priority Data

Jul. 2, 2014 (IT) ..... BO2014A0368

(51) Int. Cl.
*B65D 85/10* (2006.01)
*A24F 15/00* (2006.01)
*B65D 5/56* (2006.01)

(52) U.S. Cl.
CPC ..... *B65D 85/1045* (2013.01); *A24F 15/00* (2013.01); *B65D 5/56* (2013.01); *B65D 85/1081* (2013.01)

(58) Field of Classification Search
USPC ..... 206/259, 264, 265, 268, 271, 273
See application file for complete search history.

(56) References Cited

U.S. PATENT DOCUMENTS 6,478,149 B1 * 11/2002 Parker ..... B65D 5/18 206/264
8,276,750 B2 * 10/2012 Biondi ..... B65D 77/02 206/259

(Continued)

FOREIGN PATENT DOCUMENTS

DE 10 2009 034 705 A1 1/2011
EP 1 591 027 A1 11/2005

(Continued)

OTHER PUBLICATIONS

International Search Report for PCT Patent Application No. PCT/IB2015/054873, dated Oct. 29, 2015.

*Primary Examiner* — Jacob K Ackun
(74) *Attorney, Agent, or Firm* — Marshall, Gerstein & Borun LLP

(57) ABSTRACT

A packet of smoking articles having: a cup-shaped outer container; a cup-shaped lid hinged to the outer container to rotate, with respect to the outer container itself, between an open position and a closed position; a group of articles; an inner package which encloses the group of articles, is housed inside the outer container, and at the top and front has a lift-up portion separated from the rest of the inner package by a pre-weakened U-shaped parting line and is completely torn the first time the packet of smoking articles is opened to expose an article extraction opening; the lift-up portion of the inner package is directly in contact, without the inter- (Continued)

position of other elements with an inner surface of the top wall of the lid and with an inner surface of the front wall of the lid.

15 Claims, 10 Drawing Sheets

(56) References Cited

U.S. PATENT DOCUMENTS

| | | | | |
|---|---|---|---|---|
| 8,365,978 | B2 * | 2/2013 | Yoshimura | B65D 5/5425 206/264 |
| 8,474,612 | B2 * | 7/2013 | Bertuzzi | B65D 75/5838 206/264 |
| 8,590,701 | B2 * | 11/2013 | Bertuzzi | B65D 5/543 206/264 |
| 8,783,454 | B2 * | 7/2014 | Igo | B65D 75/5838 206/242 |
| 2005/0236283 | A1 * | 10/2005 | Ito | B65D 85/1045 206/271 |
| 2006/0249408 | A1 * | 11/2006 | Tambo | B65D 5/6691 206/264 |
| 2007/0193896 | A1 * | 8/2007 | Tanbo | B65B 11/58 206/259 |
| 2009/0071852 | A1 * | 3/2009 | Negrini | B65D 85/10 206/268 |
| 2014/0305821 | A1 * | 10/2014 | Gibson | B65D 85/1045 206/264 |

FOREIGN PATENT DOCUMENTS

| | | | |
|---|---|---|---|
| RU | 2202504 | C2 | 4/2003 |
| WO | WO-2013/120913 | A1 | 8/2013 |

* cited by examiner

PACKET OF SMOKING ARTICLES PROVIDED WITH AN INNER PACKAGE HAVING A RECLOSABLE EXTRACTION OPENING

CROSS-REFERENCE TO RELATED APPLICATIONS

This is the U.S. national phase of International Application No. PCT/IB2015/54873, filed Jun. 29, 2015, which claims the benefit of Italian Patent Application No. BO2014A000368, filed Jul. 2, 2014.

TECHNICAL FIELD

The present invention relates to a packet of smoking articles provided with an inner package having a reclosable extraction opening.

The present invention is applied advantageously to a packet of cigarettes, to which the following description will make explicit reference without loss of generality.

PRIOR ART

Normally, a rigid packet of cigarette with hinged-lid comprises an inner package which encloses a group of cigarettes and a rigid outer casing which houses the inner package.

Recently, in order to better preserve the organoleptic characteristics of the cigarette tobacco the use of a sealed inner package, which is formed by folding and heat-seal a sheet of waterproof packing material has been proposed. To allow extracting the cigarettes, the sealed inner package is provided with an extraction opening that is normally covered by an adhesive label of the "open and close" type; in particular, the adhesive label is provided with a non-dry, re-stick glue, which allows to block the adhesive label in a closed position of the cigarette extraction opening multiple times.

However, the sealed inner packages currently on the market have a relatively small extraction opening (i.e. slightly extended) and as a result the extraction of the cigarettes through the extraction opening can sometimes be difficult.

The patent application EP1591027A1 describes a rigid packet of cigarettes with hinged-lid comprising a not sealed inner package that wraps a group of cigarettes, and a rigid outer container which is provided with a hinged lid and houses the inner package. The inner package has at the top an extraction opening that is covered by a lift-up portion of the inner package, which lift-up portion is glued to an inner surface of the lid to be lifted and lowered automatically by exploiting the opening and closing movement of the lid.

DESCRIPTION OF THE INVENTION

The object of the present invention is to provide a packet of smoking articles provided with an inner package having a reclosable extraction opening, which packet of cigarettes is free from the drawbacks described above and is, at the same time, easy and inexpensive to manufacture.

According to the present invention a packet of smoking articles provided with an inner package having a reclosable extraction opening, as claimed in the attached claims is provided.

BRIEF DESCRIPTION OF THE DRAWINGS

The present invention will now be described with reference to the accompanying drawings, which illustrate a non-limitative embodiment, wherein.

PREFERRED EMBODIMENTS OF THE INVENTION

Figure 2:
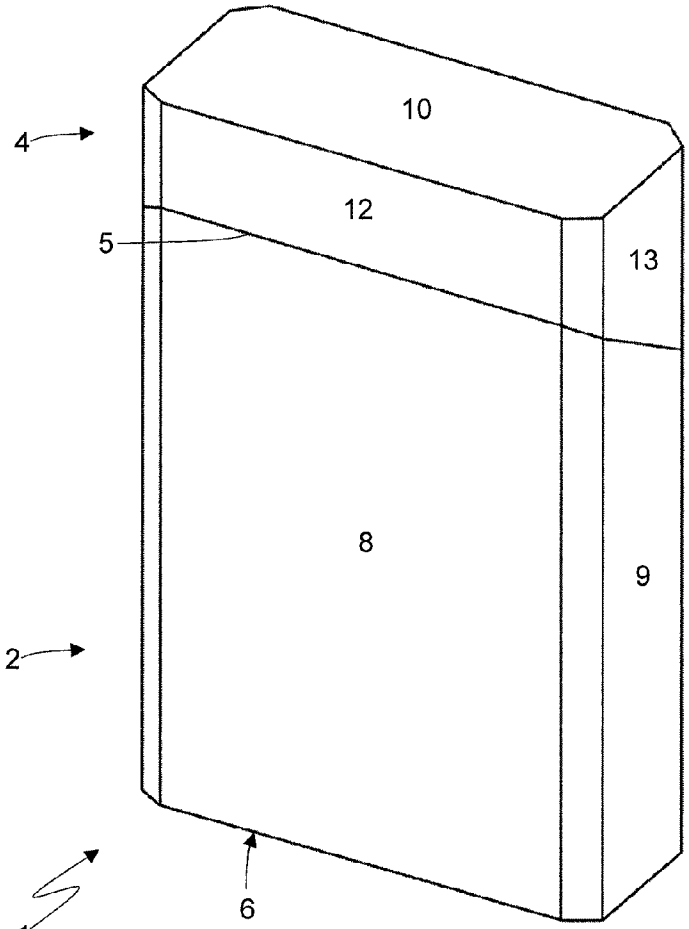
FIG. 2 is a rear perspective view of the packet of cigarettes of FIG. 1 in a closed configuration.
Figure 1:
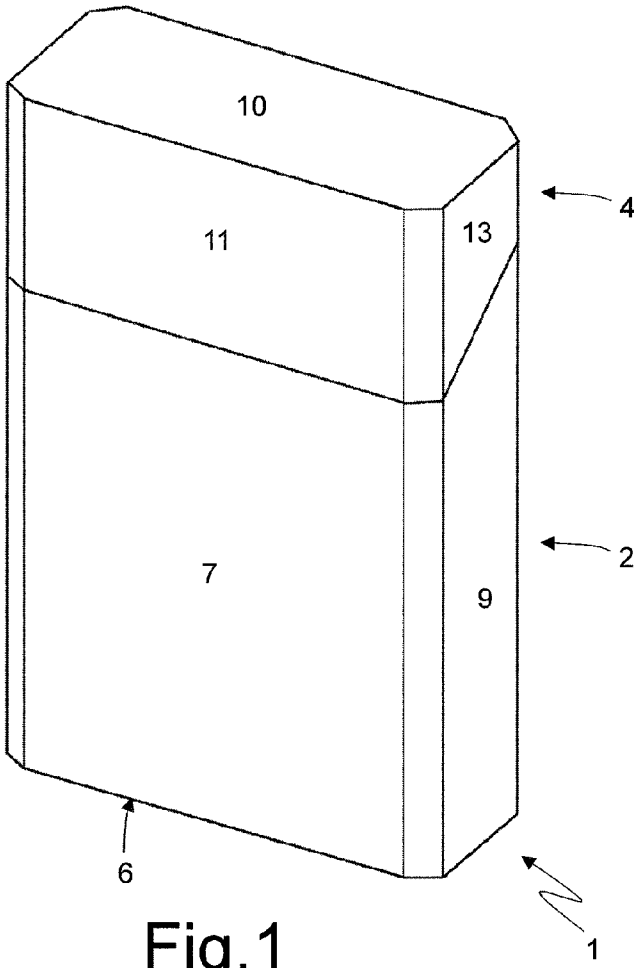
FIG. 1 is a front perspective view and in a closed configuration of a packet of cigarettes produced according to the present invention.
Figure 3:
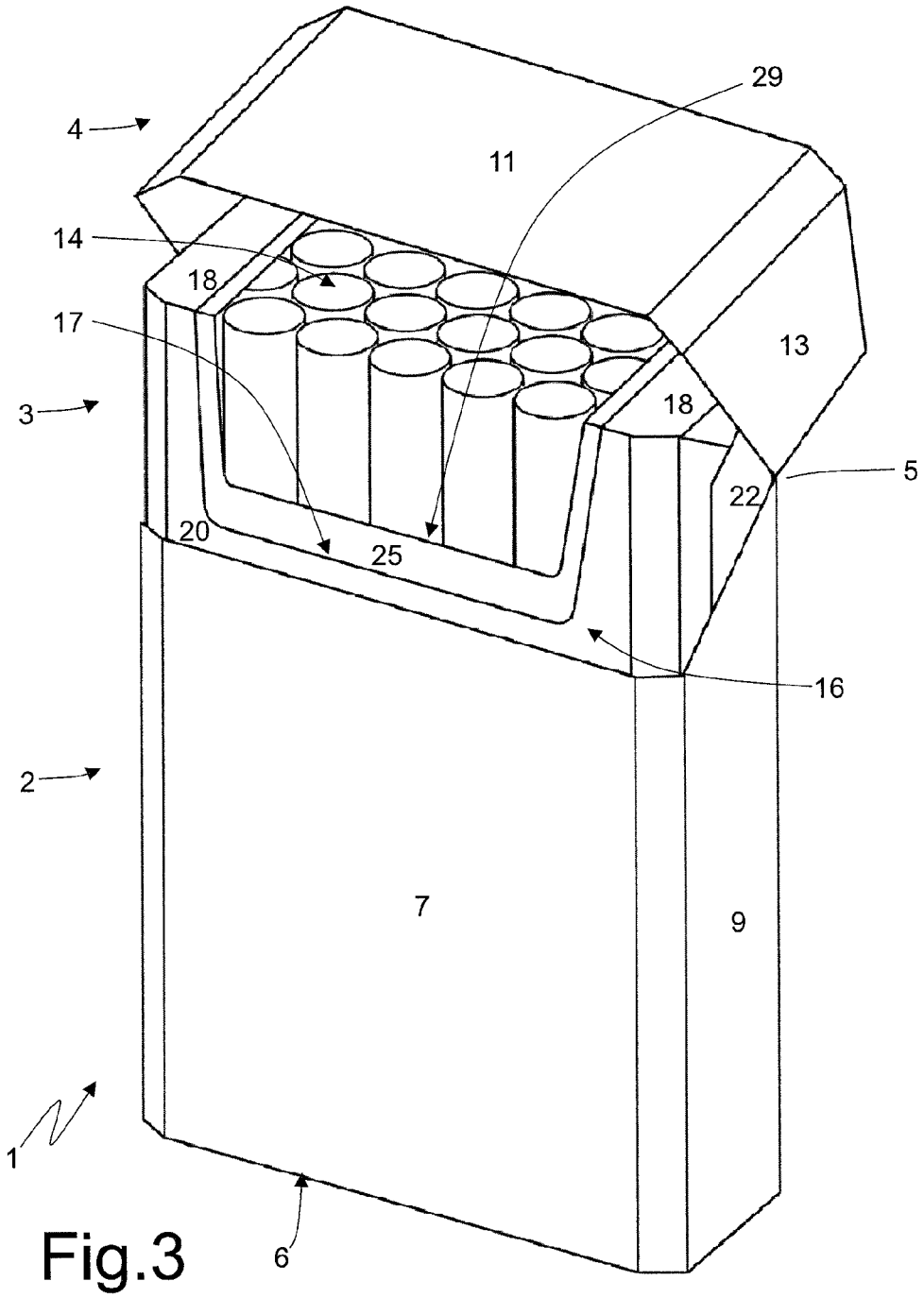
FIG. 3 is a front perspective view of the packet of cigarettes of FIG. 1 in an open configuration.

In FIGS. 1, 2 and 3 the number 1 indicates as a whole a rigid packet of cigarettes. The packet 1 of cigarettes comprises a cup-shaped outer container 2 made of cardboard or rigid paperboard and an inner package 3 (best shown in FIGS. 4 and 5) housed inside the container 2.

The outer container 2 has an open top end and is provided with cup-shaped a lid 4, and is hinged to the outer container 2 along a hinge 5 (shown in FIG. 2) to rotate, with respect to the outer container 2 itself, between an open position (illustrated in FIG. 3) and a closed position (shown in FIGS. 1 and 2) of the open top end. The outer container 2 has a substantially rectangular parallelepiped shape and has an open top end, a bottom wall 6 opposite to the open top end, a front wall 7 and a rear wall 8 (wherein the hinge 5 is formed) parallel and opposite to each other, and two lateral walls 9 parallel and opposite to each other. The lid 4 has a substantially rectangular parallelepiped shape and has an open bottom end (facing the open top end of the container 2 when the outer lid 4 is in the closed position), a top wall 10 (which is parallel and opposite to and aligned with the bottom wall 6 of the outer container 2 when the lid 4 is in the closed position), a front wall 11 (which is parallel to and aligned with the front wall 7 of the outer container 2 when the lid 4 is in the closed position), a rear wall 12 (which is parallel to and aligned with the rear wall 8 of the container 2 when the outer lid 4 is in the closed position), and two lateral walls 13 parallel and opposite to each other (which are parallel to and aligned with the lateral walls 9 of the outer container 2 when the lid 4 is in the closed position).

Figure 4:
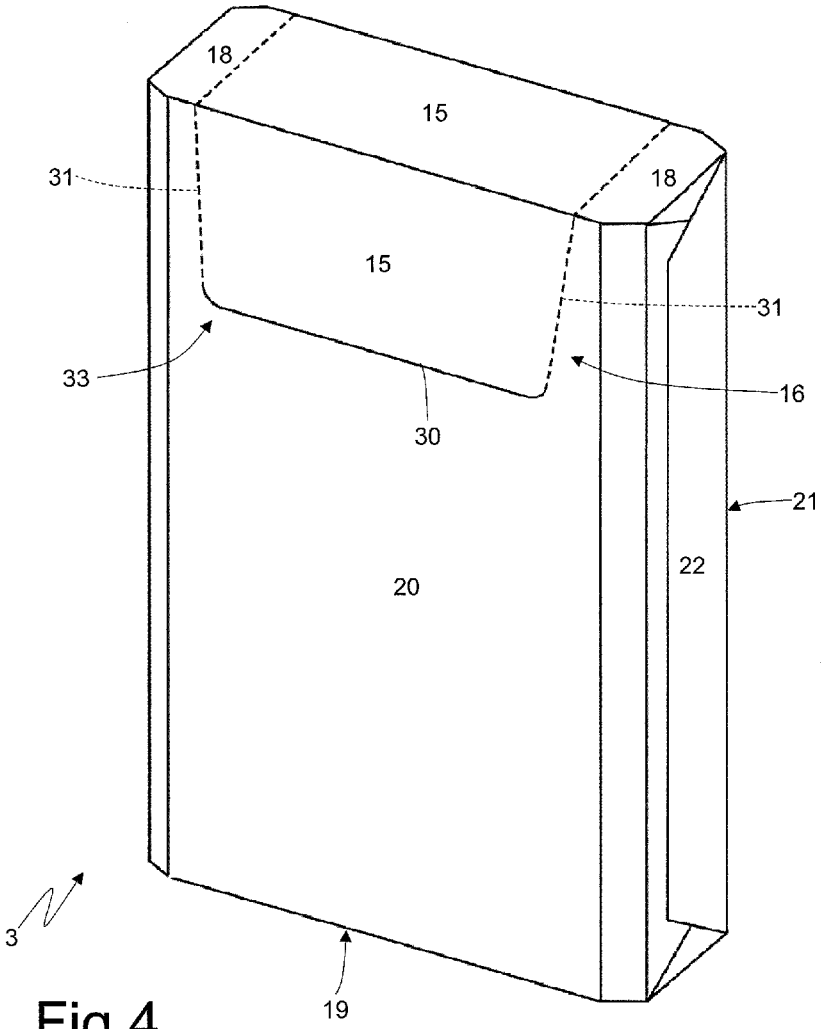
FIG. 4 is a front perspective view of an inner package of the packet of FIG. 1 in a closed configuration.
Figure 5:
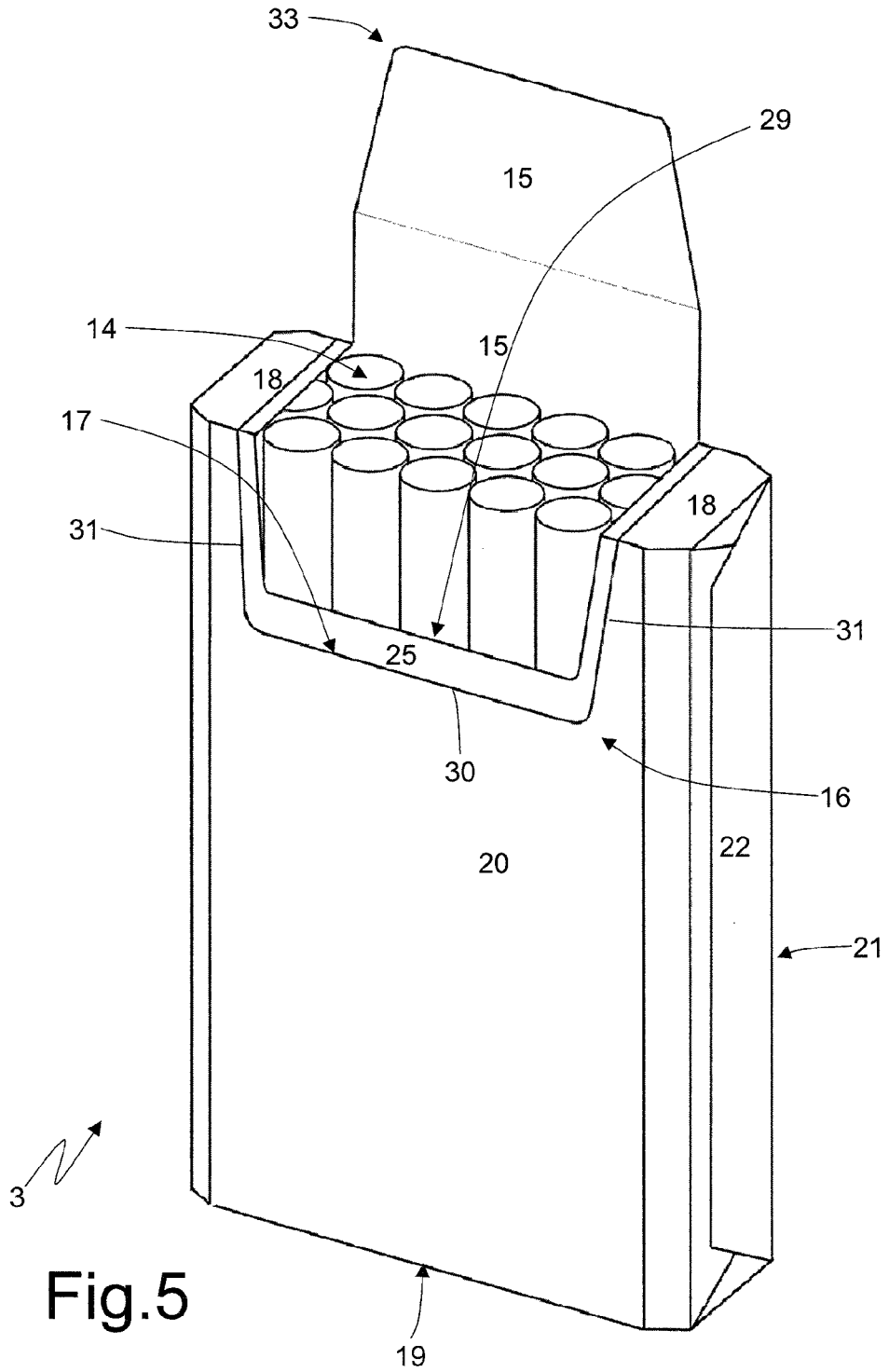
FIG. 5 is a front perspective view of the inner package of FIG. 4 in an open configuration.
Figure 6:
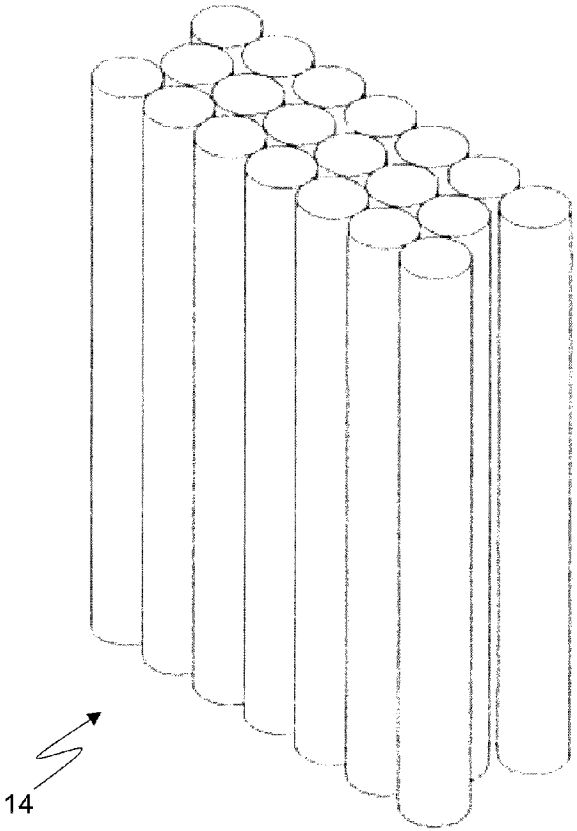
FIG. 6 is a front perspective view of a group of cigarettes contained inside the inner package of FIG. 4.

As illustrated in FIGS. 4 and 5, the inner package 3 encloses a group 14 of cigarettes (shown partly in FIG. 5 and completely illustrated in FIG. 6) of parallelepiped shape and has at the top and at the front a lift-up portion 15, which is separated from the remaining part of the inner package 3 by a U-shaped pre-weakened parting line 16 and which is torn completely the first time the packet 1 of cigarettes is opened. The lifting of the lift-up portion 15 (i.e. the detachment of the lift-up portion 15 from the remaining part of the inner package 3) frees (forms) an extraction opening 17 (illustrated in FIG. 5) which allows to access the group 14 of cigarettes contained inside the inner package 3. The lift-up portion 15 of the inner package 3 is in direct contact, without other elements in between, with an inner surface of the top wall 10 of the lid 4 and with an inner surface of the front wall 11 of the lid 4. In other words, between the inner surface the lid 4 and the lift-up portion 15 of the inner package 3 no other element is in between, and then the lift-up portion 15 is in direct contact with the inner surface of the lid 4.

The inner package 3 has a rectangular parallelepiped shape and has a top wall 18 and a bottom wall 19 parallel and opposite to each other, a front wall 20 and a rear wall 21 parallel and opposite to each other, and two lateral walls 22 parallel and opposite to each other. The lift-up portion 15 (i.e. the extraction opening 17 that corresponds in negative to the lift-up portion 15) of the inner package 3 is arranged centrally and interests (i.e. extends in) a central part (i.e. in a limited portion) of the top wall 18 and in a central part (i.e. in a limited portion) of the front wall 20.

The inner package 3 is formed by folding a waterproof and heat-sealable sheet 23 of packing material (shown in FIG. 7), which has a rectangular shape and has the parting line 16 which is U-shaped and defines the lift-up portion 15. The inner package 3 is stabilized, i.e. maintained in the folded configuration, by means of a central sealing (or longitudinal sealing) which is arranged at a front, back or bottom wall of the inner package 3 (in each case at a given distance from the lift-up portion 15 to be well separated from the lift-up portion 15 itself) and by two side sealing (or transversal sealing) which are arranged at the lateral walls of the inner package 3.

Figure 8:
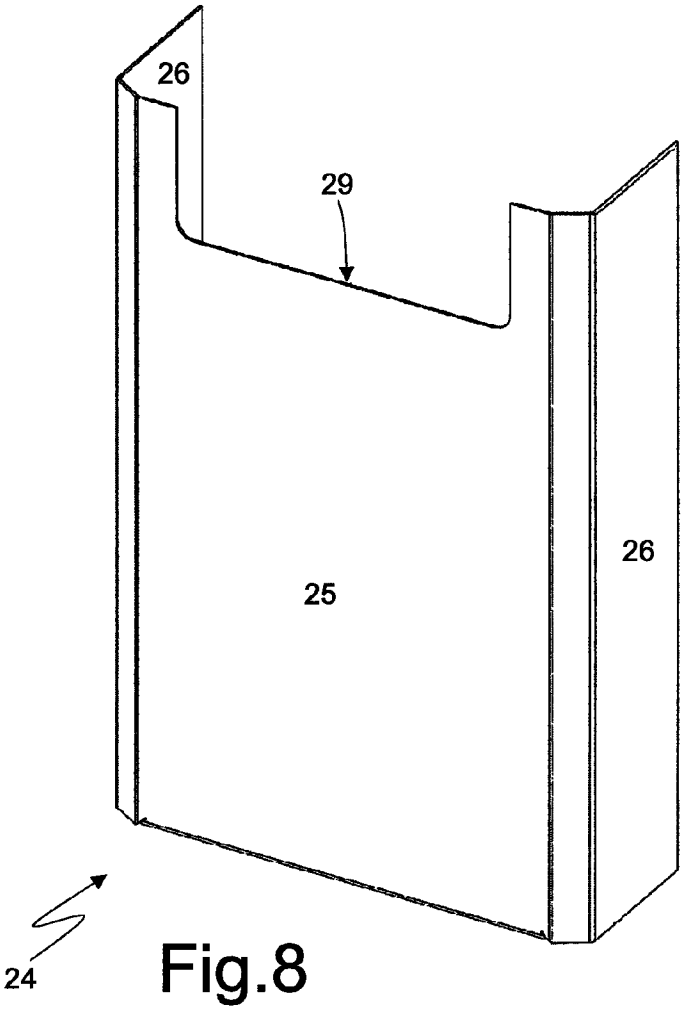
FIG. 8 is a front perspective view of a stiffener contained inside the inner package of FIG. 4.
Figure 9:
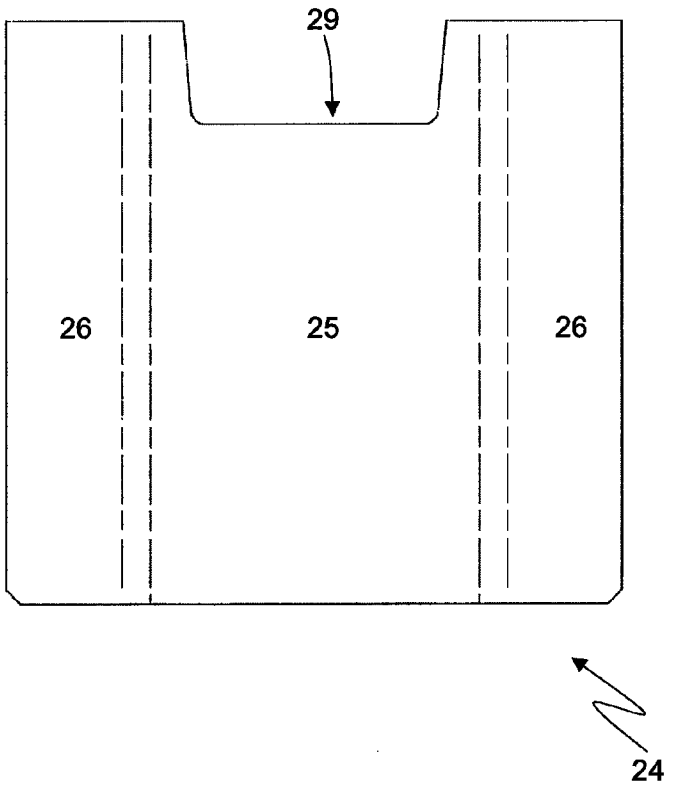
FIG. 9 is a view of a blank used to produce the stiffener of FIG. 8.

As illustrated in FIGS. 8 and 9, the inner package 3 comprises a stiffener 24, which is made of cardboard or rigid paperboard (quite similar to the cardboard or rigid cardboard constituting the outer container 2), is "U"-shaped and is arranged inside the internal to the inner package 3 contacting the group 14 of cigarettes.

The stiffener 24 comprises a front wall 25 of rectangular shape arranged on one side in contact with a front wall of the group 14 of cigarettes and from the opposite side in contact with the front wall 20 of the inner package 3 and a pair of lateral walls 26, which are connected to opposite sides of front wall 25 and are arranged on one side in contact with the lateral walls of the group 14 of cigarettes and from the opposite side in contact with the lateral walls 22 of the inner package 3. The front wall 25 of the stiffener 24 has a U-shaped window 29 which is arranged at the top and facilitates removing the cigarettes from the group 14 of cigarettes as it leaves a top area of the front wall of the group 14 of cigarettes, at the extraction opening 17, exposed. According to a different embodiment not illustrated, the stiffener 24 could comprise a lower wall arranged on one side in contact with the bottom wall of group 14 of cigarettes and from the opposite side in contact with the lower wall 19 of the inner package 3. According to a different embodiment not illustrated, the stiffener 24 may comprise two small top walls, which are connected to the lateral walls 26 and are arranged by one side in contact with the top wall of the group 14 of cigarettes and on the opposite side in contact with the top wall 18 of the inner package 3.

Figure 7:
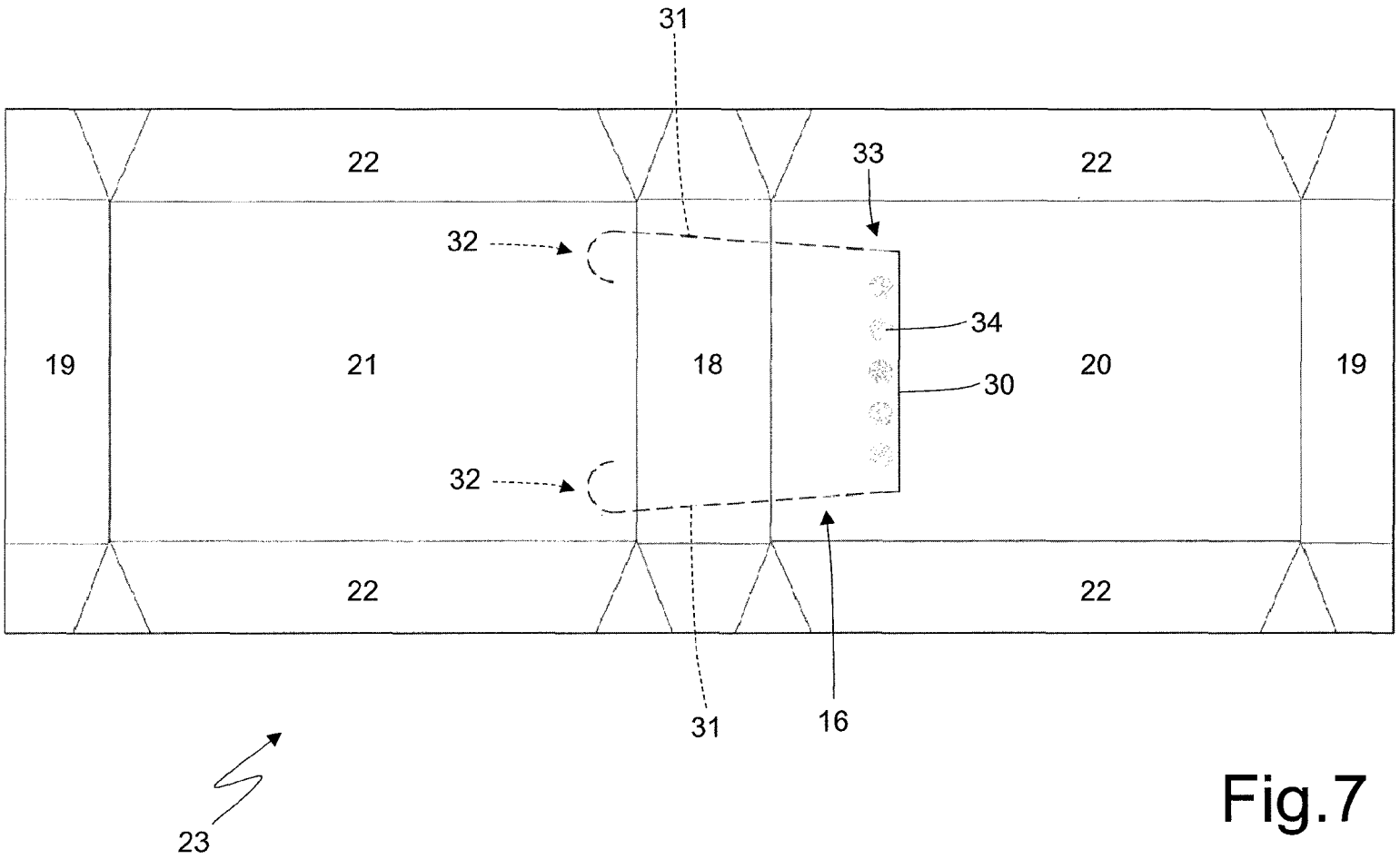
FIG. 7 is a plan view of a heat-sealable sheet of packing material used to produce the inner package of FIG. 4.

As shown in FIG. 7, the parting line 16 comprises a U-shaped transverse portion 30 (horizontally arranged) which extends in a front wall 20 of the inner package 3, and defines a continuous through cut of the inner package 3; in other words, along the transverse portion 30 of the parting line 16 the inner package 3 is completely cut from side to side without any type of link astride the transverse portion 30 itself (i.e. the transverse portion 30 of the parting line 16 is a full and total cut of the inner package 3). Furthermore, the parting line 16 comprises two longitudinal portions 31 which extend seamlessly in part in the front wall 20 of the inner package 3 and in part in the top wall 18 of the inner package 3, originate from opposite ends of the transverse portion 30, and define a tearable weakening of the inner package 3; in other words, each longitudinal portion 31 of the parting line does not define a continuous through cut of the inner package 3, but defines a weakening of the inner package 3 that can be easily torn to become, after being torn, in a continuous through cut of the inner package 3. Therefore, along the longitudinal portions 31 of the parting line 16 residual connections of the inner package 3 remain arranged astride the longitudinal portions 31 themselves. The longitudinal portions 31 of the parting line 16 may be defined by an alternation of cut lengths and intact lengths, or may be defined by a continuous non-through incision. According to a preferred embodiment, each longitudinal portion 31 of the parting line 16 ends (on the side opposite to the transverse portion 30) with a curl 32 which has the function of interrupting the propagation of the tear along the inner package 3 when the lift-up portion 15 is open (i.e. is separated from the rest of the inner package 3).

Figure 10:
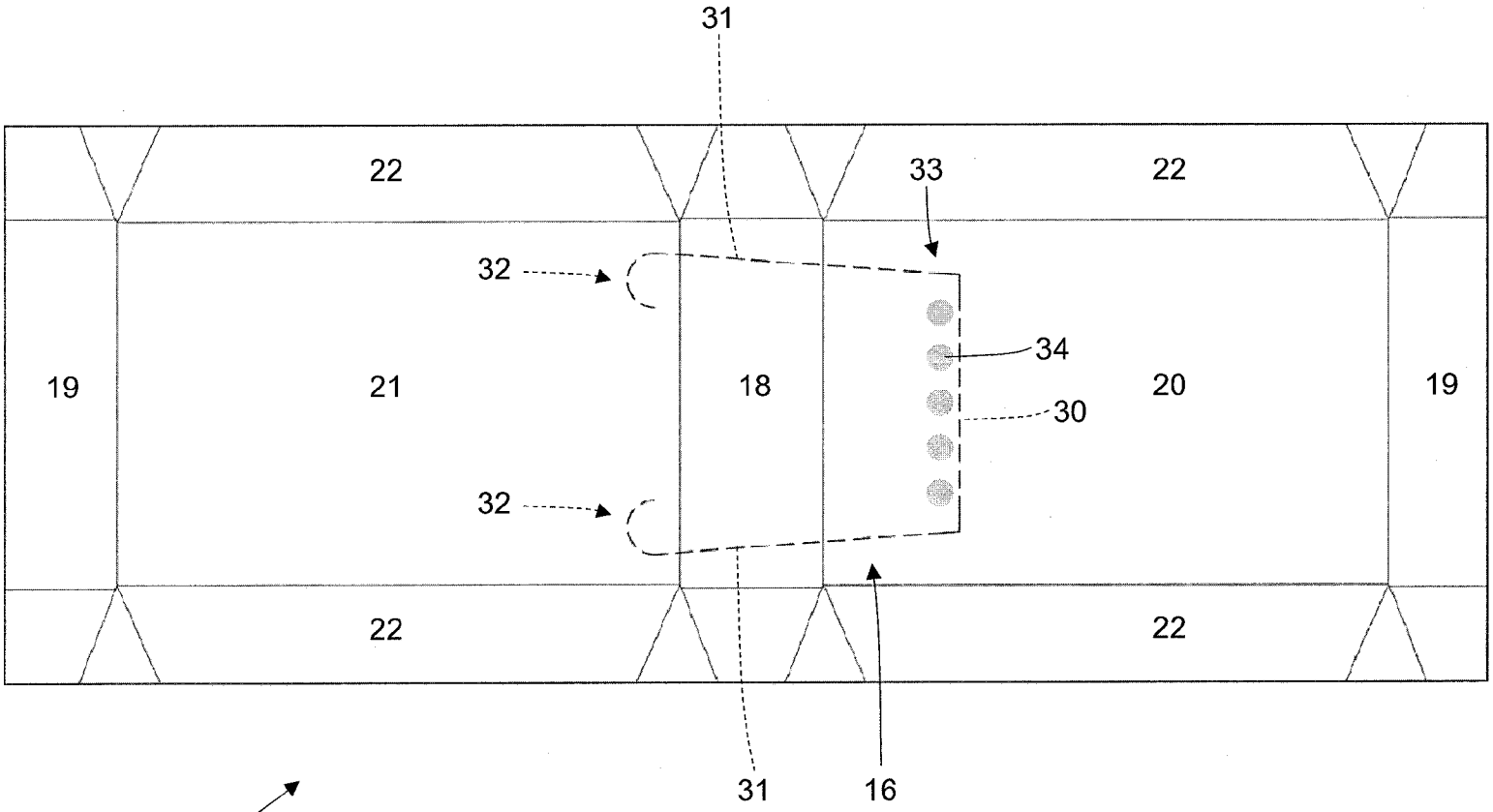
FIG. 10 is a plan view of an alternative of the sheet of packing material of FIG. 7.

In the embodiment illustrated in FIG. 7, the transverse portion 30 of the parting line 16 defines a continuous through cut in the inner package 3 while the longitudinal portions 31 of the parting line 16 define a tearable weakening of the inner package 3; however, in the alternative illustrated in FIG. 10, also the transverse portion 30 of the parting line 16 defines a tearable weakening of the inner package 3 and therefore in all its extension the parting line 16 is a tearable weakening of the inner package 3.

Figure 11:
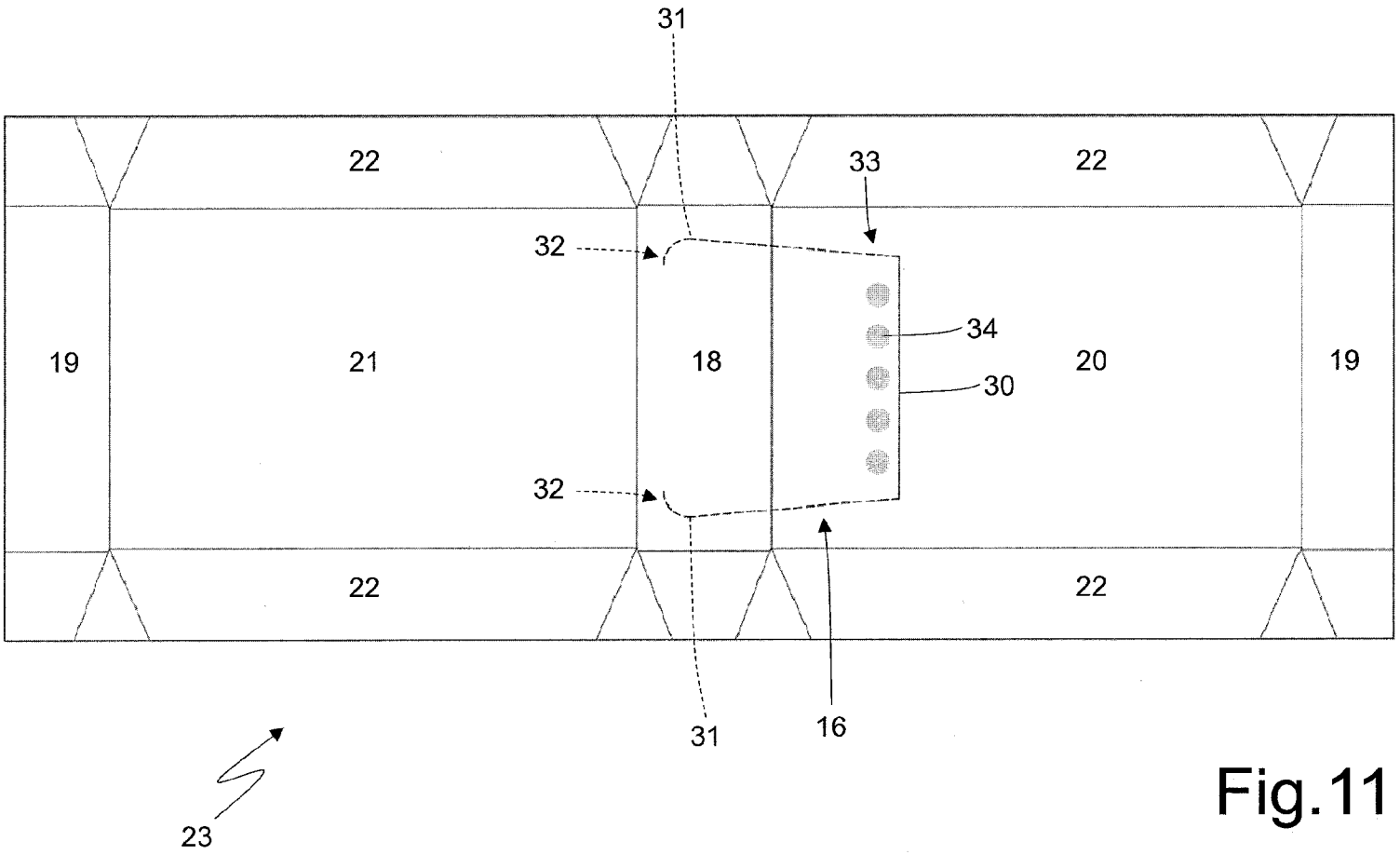
FIG. 11 is a plan view of a further alternative of the sheet of packing material of FIG. 7.

In the embodiment illustrated in FIG. 7, the parting line 16 extends partially also to a rear wall 21 of the inner package (i.e. the two longitudinal portions 31 of the parting line extend partially also to a rear wall 21 of the inner package 3). Instead, in the alternative illustrated in FIG. 11, the parting line 16 extends only to the front wall 20 and to the rear wall 21 of the inner package 3 and ends before a crosswise edge between the top wall 18 and the rear wall 21 of the inner package 3 (i.e. the two longitudinal portions 31 of the parting line 16 end before a transverse edge between the top wall 18 and the rear wall 21 of the inner package 3); in other words, the parting line 16 ends at a given distance of other than zero from the transverse edge between the top wall 18 and the rear wall 21 of the inner package 3 (i.e. the two longitudinal portions 31 of the parting line 16 end at a certain distance of other than zero from the transverse edge between the top wall 18 and the rear wall 21 of the inner package 3). The embodiment illustrated in FIG. 11 allows to keep the lift-up portion 15 at higher (better) contact with the inner surface of the lid 4, but in contrast penalizes the total dimension (area, extent) of the extraction opening 17.

As illustrated in FIG. 7, the lift-up portion 15 has a bottom end 33 which is arranged at the front wall 20 of the inner package 3 and is bounded by the transverse portion 30 of the parting line 16; in other words, the transverse portion 30 of the parting line 16 bounds (surrounds) the bottom end 33 of the lift-up portion 15 which is arranged at the front wall 20 of the inner package 3 and defines the lower part (i.e. closer to the bottom wall 19) of the lift-up portion 15.

As shown in FIG. 7, the bottom end 33 of the lift-up portion 15 is glued to the inner surface of the front wall 11 of the lid 4 by means of the permanent glue 34 (i.e. drying and that is not repositionable); i.e. the bottom end 33 of the lift-up portion 15 is glued permanently and in non-separable manner to the inner surface of the lid 4. In this way by opening or closing the lid 4 is simultaneously opened and closed also the lift-up portion 15. According to a different embodiment not illustrated, a part of the lift-up portion 15 other than the bottom end 33 could be glued permanently and in non-separable manner to the inner surface of the lid 4 in addition or as an alternative to the bottom end 33. Thanks to the fact of making the bottom end 33 of the lift-up portion 15 integral permanently to the lid 4 is possible to obtain the simultaneous movement of the lift-up portion 15 together with the lid 4. Lifting the lift-up portion 15 from the inner package 3 during the lid 4 opening takes place in a gentle and gradual manner without any load on the cigarettes contained inside the inner package 3 itself; furthermore, lowering the lift-up portion 15 on the inner package 3 during the lid 4 closing takes place in a gentle and gradual manner allowing the lift-up portion 15 to wrap in sequence and accurately the profile of the inner package 3.

Figure 12:
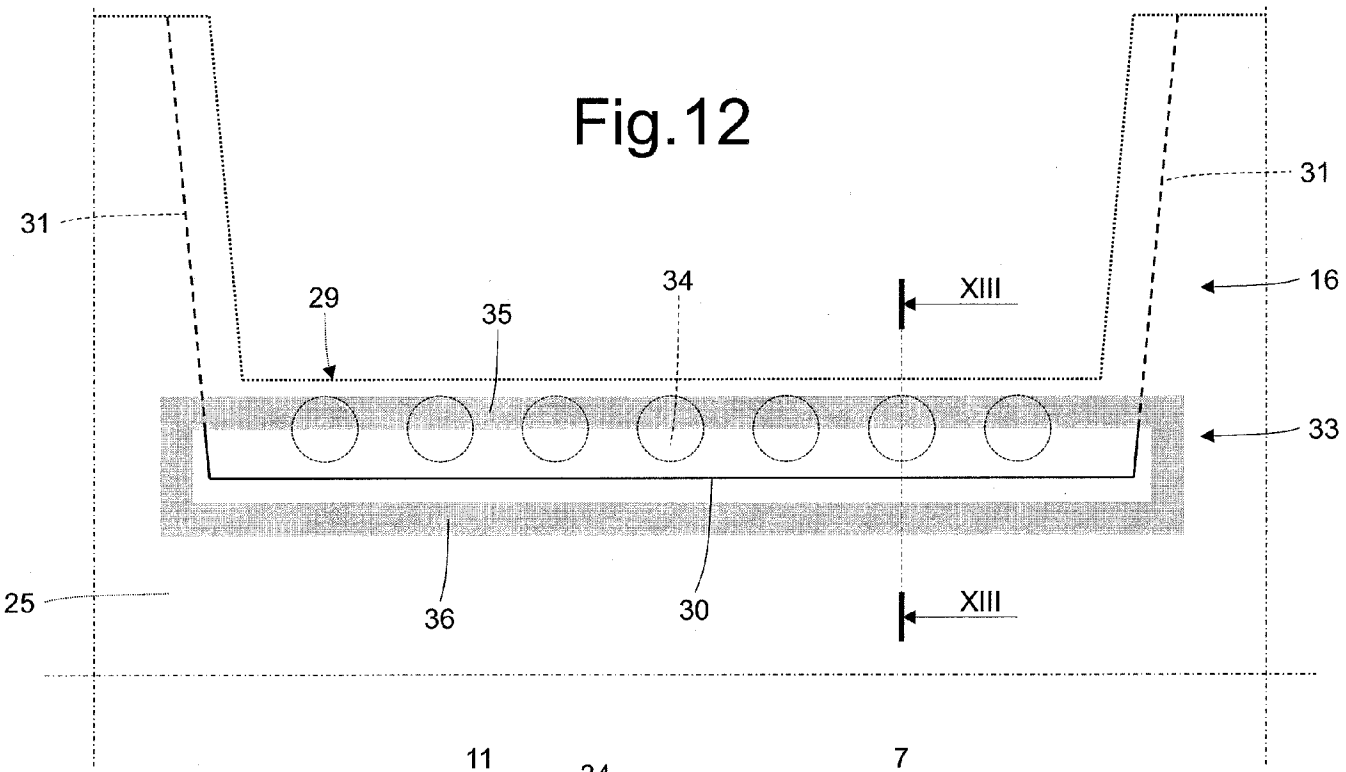
FIG. 12 is a schematic view of a detail of a front part of the inner package of FIG. 4.
Figure 13:
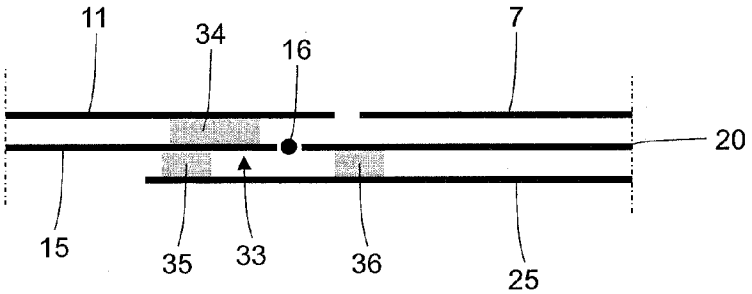
FIG. 13 is a schematic view and in section along the line XIII-XIII of a front part of the inner package of the figure.

As shown in FIG. 12, the bottom end 33 of the lift-up portion 15 leans against the front wall 25 of the stiffener 24 under the window 29; in other words, the front wall 25 of the stiffener 24 projects from the extraction opening 17 of the inner package 3 and therefore the front wall 25 of the stiffener 24 is visible through the extraction opening 17 of the inner package 3 when the lift-up portion 15 of the inner package 3 is opened (as shown in FIGS. 3 and 5). According to an alternative embodiment not illustrated, the front wall 25 of the stiffener does not project from the extraction opening 17 of the inner package 3 and therefore the front wall 25 of the stiffener 24 is not visible through the extraction opening 17 of the inner package 3 when the lift-up portion 15 of the inner package 3 is opened.

As shown in FIG. 12, the front wall 25 of the stiffener 24 has a band 35 of glue, which is arranged on an outer surface of the front wall 25 at the bottom end 33 of the lift-up portion 15 so as to glue the bottom ends 33 of the lift-up portion 15 to the front wall 25. Preferably, the band 35 of glue is arranged so as to be superimposed to the two longitudinal portions 31 of the parting line 16 above the transverse portion 30 of the parting line 16.

As shown in FIG. 12, the front wall 25 of the stiffener 24 has a band 36 of glue, which is parallel to and spaced apart from the band 35 of glue and is arranged on an outer surface of the front wall 25 lower than the bottom end 33 of the lift-up portion 15 so as to glue to the front wall 25, a front part of the inner package 3 contiguous to the lift-up portion 15 (i.e. adjacent to the lift-up portion 15 and separated from the lift-up portion 15 itself by the parting line 16). Preferably, the band 36 of glue is U-shaped and externally surrounds the bottom end 33 of the lift-up portion 15; furthermore, the ends of the band 36 of glue contact the band 35 of glue giving the two bands 35 and 36 of glue an overall ring shape bounding a central area with no glue.

According to a possible embodiment, the band 35 of glue is composed of weak-stick, drying glue that yields and loses its adhesive effect the first time the packet 1 of cigarettes is opened; according to a further embodiment, the band 35 of glue is composed of non-dry, re-stick glue, (i.e. which remains sticky), so as to repeatedly detach and re-stick the bottom end 33 of the lift-up portion 15 to the front wall 25 of the stiffener 24. Generally, for application simplicity, the band 36 of glue is composed of the same type of glue of the band 35 of glue; however, the band of glue 35 may be formed of re-stick glue while the band of glue 36 may be formed of non-dry, re-stick glue.

The presence of the band 35 of glue between the bottom end 33 of the lift-up portion 15 and the front wall 25 of the stiffener 24 determines the temporary gluing of the bottom end of the lift-up portion 15 to the front wall 25 of the stiffener 24; said gluing is temporary, since it is interrupted at the first opening of the packet 1 of cigarettes and is restored only if the band 35 of glue is composed of re-stick glue. The presence of the band of glue 36 between the inner package 3 and the front wall 25 of the stiffener 24 determines the permanent gluing (i.e. also in use is never separated) of the front wall 20 of the inner package 3 to the front wall 25 of the stiffener 24.

The function of the two bands 35 and 36 of glue is to "seal" the extraction opening 17 until the first opening of the packet 1 of cigarettes, or until complete tear of the whole parting line 16. In other words, the transverse portion 30 of the parting line 16 defines a through cut from the beginning of the inner package 3, and therefore through the transverse portion 30 of the parting line 16 the air can penetrate inside the inner package 3; the bands 35 and 36 of glue thus glue the front wall 20 of the inner package 3 to the front wall 25 of the stiffener 24 all around the transverse portion 30 of the parting line 16 thus preventing air from penetrating inside the inner package 3 passing through the transverse portion 30 of the parting line 16. That is, the transverse portion 30 of the parting line 16 is "sealed" by the two bands 35 and 36 of glue forming a "sealing" ring all around the transverse portion 30 of the parting line 16. The band 35 of glue, when is composed of re-stick glue, has the additional function of keeping the lift-up portion 15 in close contact with the front wall 25 of the stiffener 24 after the first opening of the packet 1 of cigarettes.

It is important to note that even the mere presence of the band 35 of glue (i.e. without the band 36 of glue) allows to increase the sealing of the extraction opening 17 until the first opening of the packet 1 of cigarettes, or until the complete tear of the whole parting line 16. In other words, also the band 35 of glue alone (i.e. without the band 36 of glue) increases the sealing of the extraction opening 17. Obviously, the addition also of the band 36 of glue allows to further improve the sealing of the extraction opening 17 until the first opening of the packet 1 of cigarettes, or until complete tear of the whole parting line 16.

According to a preferred, but not binding, embodiment, the stiffener 24 has externally (i.e. in contact with the sheet 23 of packing material constituting the inner package 3 and from the opposite side of the group 14 of cigarettes) a plastic coated surface, i.e. a surface covered by an outer layer of plastic material. In other words, an outer surface (arranged in contact with the sheet 23 of packing material constituting the inner package 3 and from the opposite side of the group 14 of cigarettes) of the stiffener 24 is covered with an outer layer of plastic material. For example, the outer surface of the stiffener 24 may be covered with a thin polyethylene film which can be laminated or applied by spraying or the like). Plastic coating (i.e. covering with an outer layer of plastic material) the outer surface of the stiffener 24 allows to ensure the substantial tightness of the inner package 3 (at the extraction opening 17), since it allows to ensure that the two bands 35 and 36 of glue would form a waterproof barrier in contact with the outer surface of the stiffener 24.

The embodiment illustrated in FIG. 12 also has the further advantage of particularly facilitate the trigger and the first tear propagation of the two longitudinal portions 31 of the parting line 16 at the first opening of the packet 1 of cigarettes, as the area of glue which is to be detached at the two longitudinal portions 31 (i.e. the band 35 of glue) has a reduced extension and therefore does not require the application of a high separation force.

In the embodiments illustrated in the attached figures, the longitudinal edges are chamfered; alternatively, the longitudinal edges may be rounded or straight.

The packet 1 of cigarettes described above has numerous advantages.

First, in the packet 1 of cigarettes described above the extraction opening 17 of the inner package 3 it is particularly large to the advantage of ease of extraction of the cigarettes. This result is obtained thanks to the fact that the lift-up portion 15 of the inner package 3 is in direct contact without the interposition of other elements with an inner surface of the lid 4: not having to provide additional space for other elements (typically a resealable adhesive label) the lift-up portion 15 can exploited itself all the available space with the result of being able to form a very large extraction opening 17.

Furthermore, in the packet 1 of cigarettes described above is very simple to obtain a permanent connection between the lift-up portion 15 and the inner surface of the lid 4 to obtain an "automatic" opening and closing of the lift-up portion 15 associated to the handling of the lid 4; in other words, by opening or closing the lid 4 is "automatically" and simultaneously open or closed also the lift-up portion 15.

Finally, the packet 1 of cigarettes described above is simple and inexpensive to produce, since the outer container 2 is entirely conventional and the inner package 3 requires a reduced number of elements for the production thereof (i.e. the inner package 3 comprises only the sheet 23 of packing material and the stiffener 24 without further additions).

The invention claimed is:

1. A packet (1) of smoking articles, comprising:

a cup-shaped outer container (2) having an open top end, a bottom wall (6) opposite to the open top end, a front wall (7) and an opposite, parallel rear wall (8), and two opposite, parallel lateral walls (9);

a cup-shaped lid (4) hinged to the outer container (2) to rotate, with respect to the outer container (2), between an open position and a closed position of the open top end, and having an open bottom end, a top wall (10), a front wall (11) and an opposite, parallel rear wall (12), and two opposite, parallel lateral walls (13);

a group (14) of articles;

an inner package (3) enclosing the group (14) of articles, and housed inside the outer container (2), the inner package comprising at a top and front a lift-up portion (15) separated from the rest of the inner package (3) by a pre-weakened U-shaped parting line (16) which is torn completely the first time the packet (1) of smoking articles is opened, to expose an article extraction opening (17), and without the interposition of other elements is directly in contact with an inner surface of the top wall (10) of the lid (4) and with an inner surface of the front wall (11) of the lid (4); and a stiffener (24), which is made of rigid material, arranged inside the inner package (3), contacting the group (14) of articles, the stiffener comprising a front wall (25) with a U-shaped window (29), and two lateral walls (26) connected to opposite sides of the front wall (25);

wherein the lift-up portion (15) has a bottom end (33) which is arranged at a front wall (20) of the inner package (3), and which rests on the front wall (25) of the stiffener (24), below the window (29);

wherein the front wall (25) of the stiffener (24) has a first band (35) of temporary glue, which is arranged on an outer surface of the front wall (25) at the bottom end (33) of the lift-up portion (15), inside the U-shaped parting line, to thereby temporarily glue the bottom end (33) of the lift-up portion (15) to the front wall (25), the temporary glue being interrupted at first opening of the packet (1) of cigarettes.

2. The packet (1) of smoking articles according to claim 1, wherein the lift-up portion (15) is glued to the inner surface of the lid (4).

3. The packet (1) of smoking articles according to claim 2, wherein the lift-up portion (15) has a bottom end (33) which is arranged at a front wall (20) of the inner package (3) and is glued to the inner surface of the front wall (11) of the lid (4).

4. The packet (1) of smoking articles according to claim 1, wherein the parting line (16) comprises:

a U-shaped transverse portion (30) which extends in a front wall (20) of the inner package (3) and defines a continuous through cut in the inner package (3); and two longitudinal portions (31) which seamlessly extend partly in the front wall (20) of the inner package (3) and partly in a top wall (18) of the inner package (3), originate at opposite ends of the transverse portion (30), and define a weakened tearable portion of the inner package (3).

5. The packet (1) of smoking articles according to claim 1, wherein the whole extension of the parting line (16) defines a tearable portion of the inner package (3).

6. The packet (1) of smoking articles according to claim 1, wherein the parting line (16) also extends partly to a rear wall (21) of the inner package (3).

7. The packet (1) of smoking articles according to claim 1, wherein the parting line (16) only extends to a front wall (20) and a top wall (18) of the inner package (3) and terminates short of a transverse edge between the top wall (18) and a rear wall (21) of the inner package (3).

8. The packet (1) of smoking articles according to claim 7, wherein the parting line (16) ends at a given distance of other than zero from a transverse edge between the top wall (18) and rear wall (21) of the inner package (3).

9. The packet (1) of smoking articles according to claim 1, wherein the parting line (16) comprises:

a U-shaped transverse portion (30) which extends in a front wall (20) of the inner package (3) and defines a continuous through cut in the inner package (3); and two longitudinal portions (31) which seamlessly extend partly in the front wall (20) of the inner package (3) and partly in a top wall (18) of the inner package (3), originate from opposite ends of the transverse portion (30), and define a tearable portion of the inner package (3);

wherein the first band (35) of glue is arranged so as to overlap the two longitudinal portions (31) of the parting line (16) above the transverse portion (30) of the parting line (16).

10. The packet (1) of smoking articles according to claim 1, wherein the first band (35) of glue is composed of weak-stick, drying glue that yields and loses its adhesive effect the first time the packet (1) of smoking articles is opened.

11. The packet (1) of smoking articles according to claim 1, wherein the first band (35) of glue is composed of weak-stick, drying glue, so as to repeatedly detach and re-stick the bottom end (33) of the lift-up portion (15) to the front wall (25) of the stiffener (24).

12. The packet (1) of smoking articles according to claim 1, wherein the front wall (25) of the stiffener (24) has a second band (36) of glue, which is parallel and spaced apart from the first band (35) of glue and is arranged on an outer surface of the front wall (25), outwards of the bottom end (33) of the lift-up portion (15), so as to glue a portion of the inner package (3), contiguous to the lift-up portion (15), to the front wall (25).

13. The packet (1) of smoking articles according to claim 12, wherein the second band (36) of glue is U-shaped and externally surrounds the bottom end (33) of the lift-up portion (15).

14. The packet (1) of smoking articles according to claim 13, wherein the ends of the second band (36) of glue contact the first band (35) of glue, so that the two bands (35, 36) of glue together form a ring shape bounding a central area without glue.

15. The packet (1) of smoking articles according to claim 1, wherein:

the stiffener (24) is made of cardboard or rigid paperboard; and at least the outer surface of the front wall (25) of the stiffener (24) is plastic coated, i.e. is covered by an outer layer of plastic material.

* * * * *